United States Patent [19]

Bassett

[11] 4,068,157

[45] Jan. 10, 1978

[54] REGULATED MULTIPLE TRANSFORMER SYSTEM

[75] Inventor: John A. Bassett, Westford, Mass.

[73] Assignee: Sola Basic Industries, Inc., Milwaukee, Wis.

[21] Appl. No.: 695,969

[22] Filed: June 14, 1976

Related U.S. Application Data

[63] Continuation of Ser. No. 528,426, Nov. 29, 1974, abandoned.

[51] Int. Cl.[2] ..... G05F 1/64

[52] U.S. Cl. ..... 363/75; 323/24; 323/34; 323/60

[58] Field of Search ..... 321/18, 25; 323/6, 18, 323/24, 34, 60, 61, 62

[56] References Cited

U.S. PATENT DOCUMENTS

| | | | |
|---|---|---|---|
| Re. 27,916 | 2/1974 | Kakalec | 323/60 X |
| 3,040,233 | 6/1962 | Bixby | 321/25 X |
| 3,076,924 | 2/1963 | Manteuffel | 321/25 UX |
| 3,530,358 | 9/1970 | Thompson | 323/24 X |
| 3,532,855 | 10/1970 | Cleave | 323/24 X |
| 3,573,605 | 4/1971 | Hart et al. | 323/60 X |
| 3,739,257 | 6/1973 | Hunter | 323/60 X |
| 3,889,176 | 6/1975 | Randall | 323/34 X |

OTHER PUBLICATIONS

Hunter, "Variable Flux-Reset Ferroresonant Voltage Regulator," IEEE Transactions on Magnetics, Sept. 1971, pp. 564–567, S26540008.

*Primary Examiner*—A. D. Pellinen

*Attorney, Agent, or Firm*—Parmelee, Johnson & Bollinger

[57] ABSTRACT

A circuit is provided for providing a regulated d.c. output of a substantially high output current magnitude from an unregulated single or polyphase a.c. input source. Regulation is provided by a single feedback circuit interacting with a plurality of ferroresonant transformers connected in parallel to a single phase source, singly on each phase or a polyphase source, or interconnected in the known Scott T connection on a three phase source. Regulation is accomplished with thyristor switches which are synchronized with the input phase of each transformer.

2 Claims, 5 Drawing Figures

TIME DELAY CIRCUIT
TIME DELAY CIRCUIT
TIME DELAY CIRCUIT
FEEDBACK CONTROL AMPLIFIER
10
10'
10''
11
11'
11''
12
12'
12''
13
13'
13''
14
14'
14''
15
15'
15''
16
16'
16''
17
17'
17''
18
18'
18''
21
21'
21''
22
23
23'
23''
20
30
30'
30''
31
31'
31''
32
32'
32''
33
33'
33''
34
34'
34''
35
35'
35''
36
36'
36''
37
37'
37''
$\Phi_1$
$\Phi_2$
$\Phi_3$

REGULATED MULTIPLE TRANSFORMER SYSTEM

This invention relates to a single or polyphase system providing a regulated output.

The invention concerns an arrangement wherein a ferroresonant transformer regulator produces a regulated output from an unregulated a.c. source, the output being rectified and supplied to a d.c. load such as a storage battery, such arrangement being well known in the art. They are well accepted and generally used because they combine the advantages of accurate regulation, lack of moving parts, compactness, reasonable cost and a requirement of minimum upkeep. However, serious problems arise when such arrangements are to be used in applications where the current magnitude requirements are very large, such as, in excess of 200 amps, and where multiple transformers are used in combination.

One of the objects of the invention is to provide a ferroresonant rectifier system which will operate satisfactorily to provide very high values of regulated d.c. current to a d.c. load.

A further object of this invention is to provide a ferroresonant rectifier system which will operate satisfactorily in a multiple transformer arrangement in such a manner that the current delivered by each transformer is inherently balanced while the summation of all currents is regulated.

In one aspect of the invention, an input of one, two, three or more phases can be used to obtain a regulated d.c. voltage output, each of the ferroresonant transformers having a primary winding connected to its phase, singly or in parallel with primary windings of other transformers, and two secondary windings, the first secondary winding producing a load current and the second secondary winding having a capacitor providing a ferroresonant system. The first secondary of each transformer can be connected to a rectifying circuit which can be connected in parallel with rectifying circuits connected to other secondaries, each providing an equal share of current to the d.c. load. There is a circuit connected in shunt with each of the capacitors and including switching means having timing means responsive to the zero voltage crossover of the voltage at the primary winding, the timing interval for all switching circuits in the system being responsive to a single feedback circuit means connected to the common d.c. output voltage.

These and other objects, advantages and features of the invention will become apparent from the following description and drawings which are merely exemplary.

In the drawings.

Where appropriate, the same reference numerals will be used on the various figures to depict the same or similar components and connections.

Figure 2:
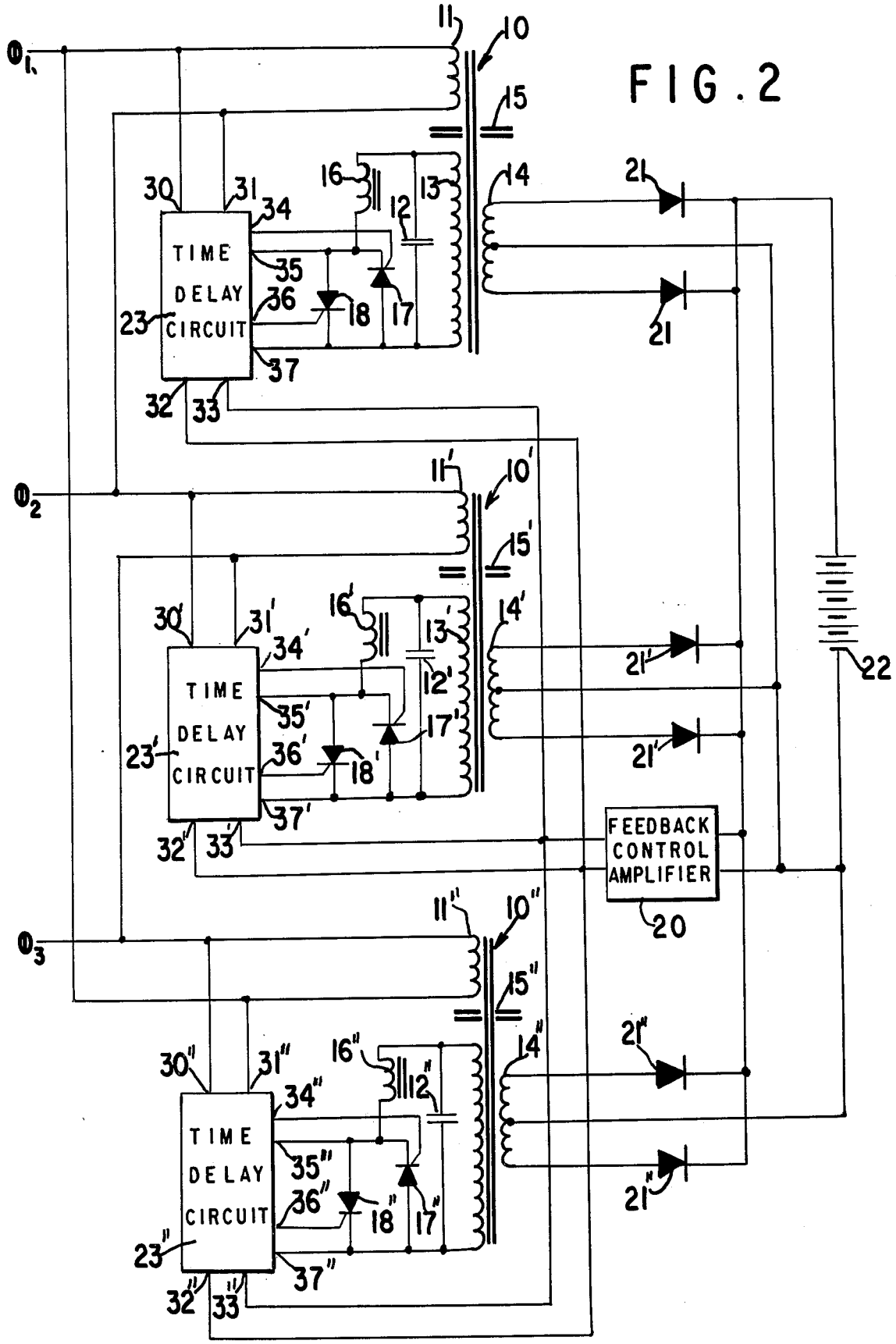
FIG. 2 is a wiring diagram showing a polyphase embodiment.

Referring to FIG. 2, a three phase source having the phases $\phi_1$, $\phi_2$, $\phi_3$, which may be connected in either Y or delta, is used to energize the system. Each of the phases is connected to its corresponding primary winding 11, 11', 11'' of high reactance transformers 10, 10', 10''. Since the phases are symmetrical, reference will be made to only one of the phases, the description thereof being equally applicable to the remaining phases. High reactance transformer 10, including primary winding 11, shunt 15, secondary winding 14 and auxiliary secondary winding 13 in combination with capacitor 12, constitutes a ferroresonant regulator which is well known in the art as shown by U.S. Pat. Nos. 2,143,745; 2,346,621; 2,535,169; 2,649,177 and 3,292,537, all issued to Joseph G. Sola. While these regulators are satisfactory, their use in a polyphase arrangement sometimes raises problems since the requirement for symmetrical loading of the phases may be difficult to solve in some arrangements.

Connected in shunt with capacitor 12 is the circuit comprising reactor 16 and reversly connected SCR's or thyristors 17, 18. Symmetrical operation is obtained by gating the SCR's in alternate half cycles of the primary voltage after a delay interval. The output currents in the several secondary windings 14, 14', 14'' are connected individually to rectifier circuits 21, 21', 21'' and the resulting d.c. is combined and applied to a load such as storage battery 22.

The d.c. output voltage is applied to feedback control amplifier 20 which includes reference voltage means and necessary conventional stability compensation networks. The output of the control amplifier is the amplified difference between the reference voltage and the d.c. output voltage. The techniques associated with such amplifiers are well established in the art, the relationship to the present invention being that the amplified difference voltage is used to determine the delay interval of all switching circuits.

Switching control circuits 23, 23', 23'', each of which in turn controls its corresponding pair of SCR's, have for inputs the primary voltage and the amplified difference signal, provide output gate signals to initiate the conductive state of the SCR's . It is significant to the nature of this invention that the phase or other a.c. characteristics of the secondary voltage does not influence the delay time, and that all switching circuits comprising the system have the same delay time.

Figure 1:
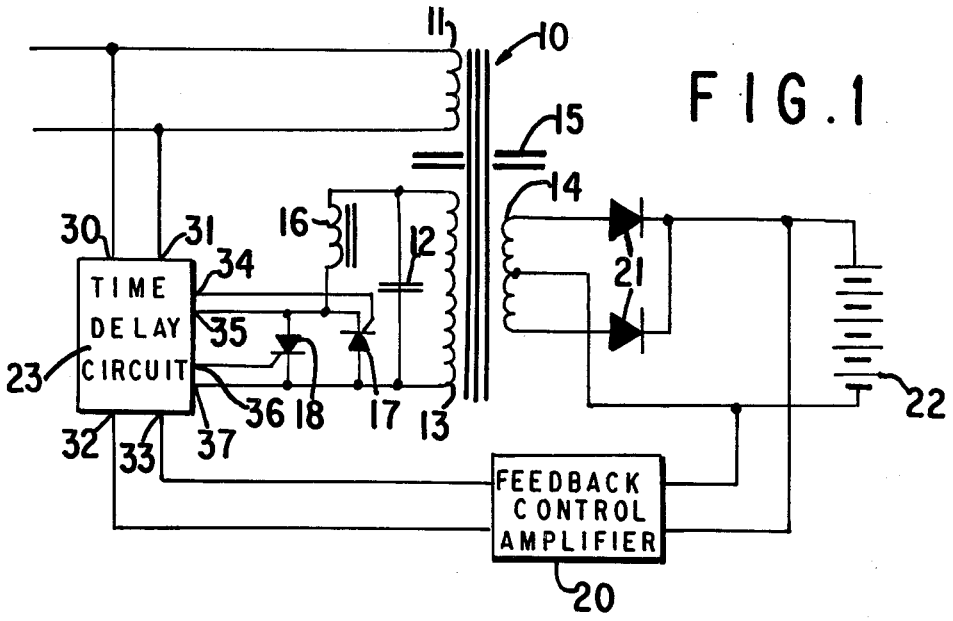
FIG. 1 is a wiring diagram showing a single phase embodiment of the present invention.
Figure 3:
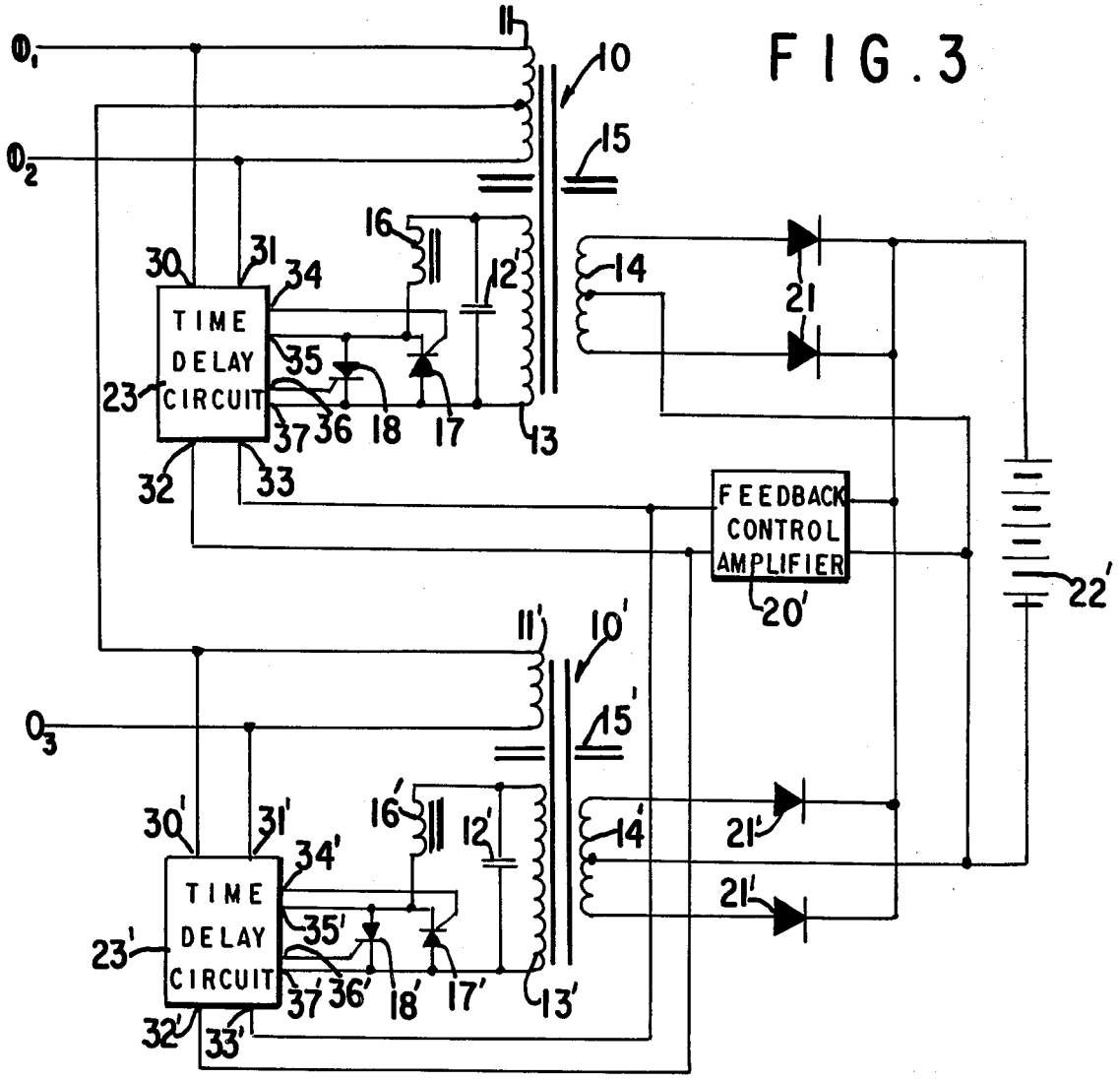
FIG. 3 is a wiring diagram showing a Scott T embodiment.
Figure 4:
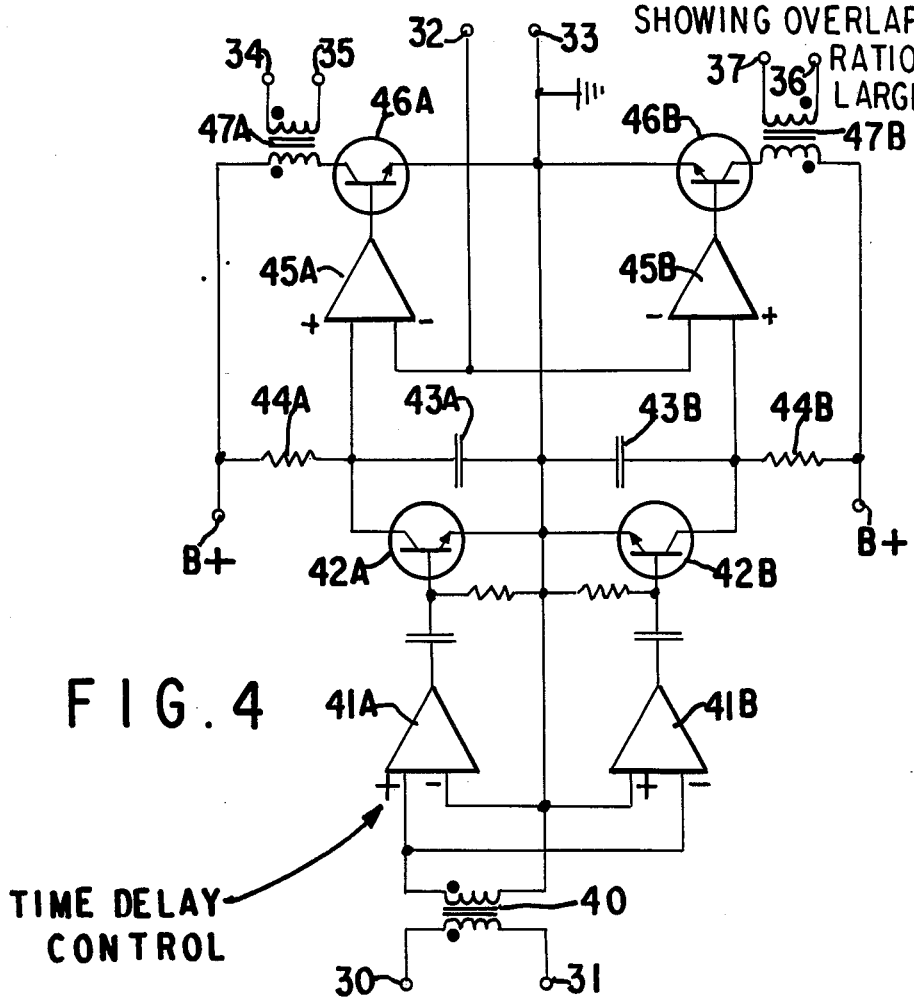
FIG. 4 is a wiring diagram showing a phase timing circuit for controlling each regulating transformer.

Referring to FIG. 4, the details of one of the delay time control circuits is shown. Terminals 30, 31 thereof as seen in FIGS. 1, 2 and 3 are connected to a corresponding input phase, terminals 32, 33 are connected to the amplified difference voltage, and terminals 34, 35, 36, 37 are connected to the SCR gates. It is to be noted that the circuitry after amplifier 41A is duplicated by the circuitry following differential amplifier 41B, such being necessary to allow overlapping operation on the positive and negative half cycles of input voltage to produce a very large phase delay.

Describing one phase, as soon as the primary voltage from the corresponding phase represented by $\phi$, sampled by transformer 40, crosses zero (FIG. 5) at 60 and becomes positive, the output of differential amplifier 41A is driven positive which turns on transistor 42A to discharge capacitor 43A momentarily at 61. The capacitor 43A will immediately begin to recharge as shown by ramp 63 through resistor 44A, the rate of rise of capacitor voltage being unaffected by input or output voltage variations. When the capacitor voltage, which is connected to the positive input of differential amplifier 45A exceeds the control signal, which is the output of the feedback control amplifier present at terminal 32 which is connected to the negative input of differential amplifier 45A, the output of the differential amplifier 45A goes positive. This turns on transistor 46A which supplies energy to pulse transformer 47A which in turn gates the SCR connected to secondary 34, 35. On the other half cycle of input power, the complementary circuit, including differential amplifier 41B as seen by ramp 65 operates identically to produce a pulse at transformer 47B.

The time T, which is representative of not only T, but also T′ and T″, taken for the voltage on capacitor 43A to rise to the value of the control signal determines, such as at 64, the time delay of the gate pulse from the initial primary zero voltage crossing. As the control signal increases, the phase delay increases since the voltage on capacitor 43A must rise to a higher value. Most effective control occurs at phase angles between 90° and 270° lagging from the primary voltage and the circuit of FIG. 2 will allow control from 0° to 360° degrees.

Since the firing of an SCR causes the termination of a secondary half cycle and the ramp signal on capacitor 43A fixes a delay time from the beginning of a primary half cycle to a gate pulse, the phase angle between primary and secondary is proportional to the control signal. This determines the voltage across the internal impedance of the high reactance transformer and thereby determines the output current of the respective transformer. T, T′ and T″ relate to phases 1, 2 and 3, respectively.

Figure 5:
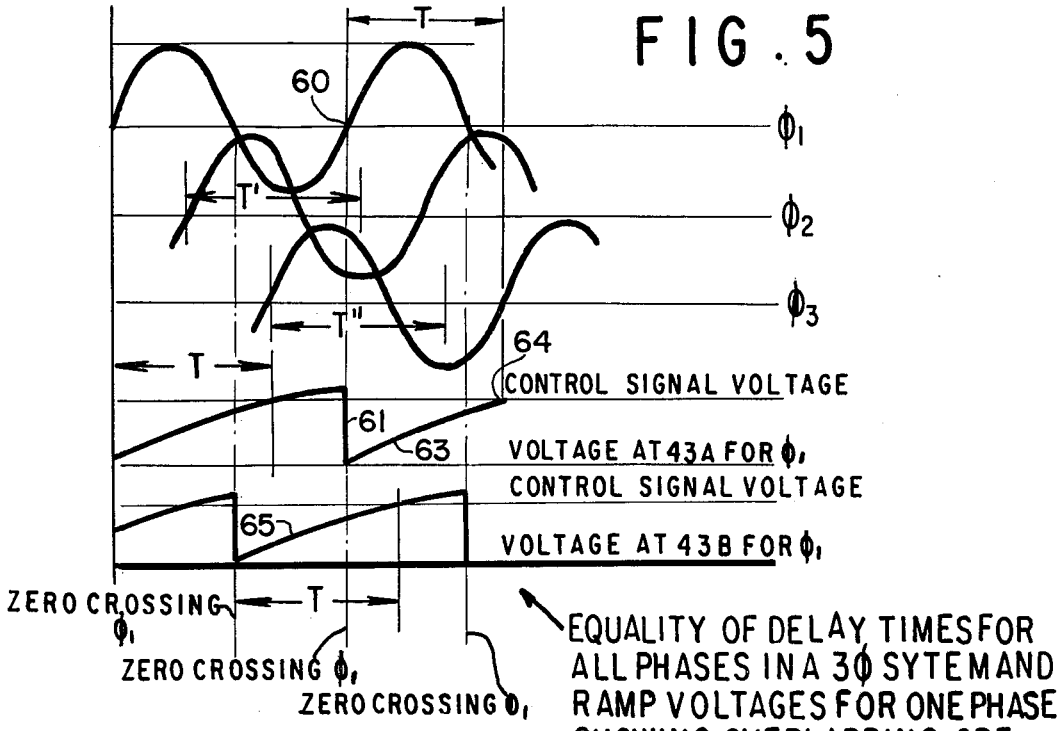
FIG. 5 shows the timing relation of the control circuits in a typical three phase system.

This is particularly significant in the case of polyphase control. Since each circuit 23, 23′, 23″ is tied to the primary voltage crossing of its related phase, as is shown in FIG. 5, it necessarily follows that the phase shift across each transformer will be the same with a consequent balanced loading of each. Additionally, the transformers respond only to the parameters incorporated into the feedback control amplifier 20 which relieves the system of objectional oscillatory modes and jump phenomena common to ferroresonance.

The circuit of FIG. 3 shows the polyphase circuitry connected in a Scott T with the remainder of the elements connected as described in FIGS. 1, 2, and 4.

Two secondaries for each ferroresonant transformer are shown and preferred, but these can be arranged in other manner.

It is apparent that variations can be made of circuitry and arrangement thereof without departing from the spirit of the invention except as defined by the appended claims.

What is claimed is:

1. A polyphase ferroresonant rectifier system for deriving a regulated d.c. output voltage from an unregulated polyphase a.c. source comprising a plurality of transformers, each of said transformers comprising a primary winding, said polyphase a.c. source being connected in Scott T relation with the primary windings of said transformers, each of said transformers including two secondary winding means loosely coupled to the primary winding thereof, the first of said secondary winding means producing a load current and the second of said secondary winding means being shunted by a capacitor to produce a ferroresonant system, a circuit in shunt to each of said capacitors comprising a reactor in series with a switch means, means for gating said switch means comprising timing means including means responsive to the zero voltage crossover of its respective phase, and single delay time controlling means responsive to the voltage level of said d.c. output for controlling the delay time of each of said timing means, said delay time being identical but time displaced by the angular displacement of the phases as evinced by their respective zero voltage crossover times, whereby the load current in the several secondaries are accurately balanced, said delay time controlling means including, a sampling transformer for sampling the voltage across said primary winding, a first differential amplifier, means for applying said sampled voltage to the input of said first differential amplifier, a first transistor in circuit with the output of said first differential amplifier, the output of said first differential amplifier being driven positive when said sampled voltage crosses zero in a positive direction, said positive output of said first differential amplifier activating said first transistor into a conducting state, a control capacitor shunted across said first transistor, said control capacitor being discharged when said first transistor is in said conducting state, means for charging said control capacitor, a second differential amplifier, the positive input of said second differential amplifier being the voltage across said control capacitor, means for generating a control signal which is equivalent to the difference between said d.c. output voltage and a predetermined reference voltage, means for applying said control signal to the negative input of said second differential amplifier, a second transistor in circuit with the output of said second differential amplifier, said second transistor being activated into its conducting state when the output of said second differential amplifier is positive, a pulse transformer in circuit with said second transistor for generating a pulse when said second transistor is in its conducting state and for supplying said pulse to said means for gating said switching means, whereby the delay time is determined by the time it takes for the voltage of said control capacitor to rise to the value of said control signal and the delay time can be adjusted by adjusting the value of the control signal.

2. A polyphase ferroresonant rectifier system for deriving a regulated d.c. output voltage from an unregulated polyphase a.c. source comprising a plurality of transformers each coupled to a single phase of said polyphase source, each of said transformers comprising a primary winding connected to a corresponding phase of said polyphase source, two secondary winding means loosely coupled to the primary winding thereof, the first of said secondary winding means producing a load current and the second of said secondary winding means being shunted by a capacitor to produce a ferrroresonant system, a circuit in shunt to each of said capacitors comprising a reactor in series with a switch means, means for gating said switch means comprising timing means including synchronization means responsive to the zero voltage crossover of its respective phase source voltage causing its switching means to be responsive to the phase angle between the source voltage and the voltage across said second secondary winding means, and single delay time controlling means responsive to the voltage level of said d.c. output for controlling the delay time of each of said timing means, said delay time controlling means including, a sampling transformer for sampling the voltage across said primary winding, a first differential amplifier, means for applying said sampled voltage to the input of said first differential amplifier, a first transistor in circuit with the output of said first differential amplifier, the output of said first differential amplifier being driven positive when said sampled voltage crosses zero in a positive direction, said positive output of said first differential amplifier activating said first transistor into a conducting state, a control capacitor shunted across said first transistor, said control capacitor being discharged when said first transistor is in said conducting state, means for charging said control capacitor, a second differential amplifier, the positive input of said second differential amplifier being the voltage across said control capacitor, means for generating a control signal which is equivalent to the difference between said d.c. output voltage and a predetermined reference voltage, means for applying said control signal to the negative input of said second differential amplifier, a second transistor in circuit with the output of said second differential amplifier, said second transistor being activated into its conducting state when the output of said second differential amplifier is positive, a pulse transformer in circuit with said second transistor for generating a pulse when said second transistor is in its conducting state and for supplying said pulse to said means for gating said switching means, whereby the delay time is determined by the time it takes for the voltage of said control capacitor to rise to the value of said control signal and the delay time can be adjusted by adjusting the value of the control signal, said delay time for each of said delay time controlling means being identical but time displaced by the angular displacement of the phases as evinced by their respective zero voltage crossover times, whereby the load currents in the several secondaries are accurately balanced.

* * * * *